US006047452A

United States Patent [19]

Caruso

[11] Patent Number: 6,047,452

[45] Date of Patent: Apr. 11, 2000

[54] CYLINDRICAL BELT FINISHING MACHINE FOR KNIT FABRIC

[76] Inventor: Frank Caruso, 40-14 22th St., Bayside, N.Y. 11361

[21] Appl. No.: 09/208,661

[22] Filed: Dec. 10, 1998

Related U.S. Application Data

[60] Provisional application No. 60/072,408, Jan. 23, 1998.

[51] Int. Cl.[7] ..... D06C 21/00

[52] U.S. Cl. ..... 26/18.6; 26/80; 28/142

[58] Field of Search ..... 26/18.6, 51, 80, 26/83, 84, 85, 71; 57/1 UN; 66/149 R, 152, 153, 150, 151; 112/63; 38/70; 28/142

[56] References Cited

U.S. PATENT DOCUMENTS

| | | | |
|---|---|---|---|
| 779,764 | 1/1905 | Burns | 112/63 |
| 973,530 | 10/1910 | McKane | 112/63 |
| 1,133,078 | 3/1915 | Williams | 66/153 |
| 1,259,478 | 3/1918 | Bechtel | 66/153 |
| 1,964,691 | 6/1934 | Shippling | 26/85 |
| 2,189,166 | 2/1940 | Cohn et al. . | |
| 2,294,642 | 9/1942 | Wedler . | |
| 2,410,146 | 10/1946 | Birch . | |
| 3,104,464 | 9/1963 | Frink . | |
| 3,501,818 | 3/1970 | Heitkamp . | |
| 3,586,602 | 6/1971 | Schmidt | 26/18.6 |
| 4,118,179 | 10/1976 | Ballinger | 26/18.6 |
| 4,124,350 | 11/1978 | Mercer . | |
| 4,266,983 | 5/1981 | Laszlo et al. . | |
| 4,337,630 | 7/1982 | Strahm | 26/85 |
| 5,442,842 | 8/1995 | Nielsen et al. | 26/80 |
| 5,519,922 | 5/1996 | Strudel | 26/84 |
| 5,918,353 | 7/1999 | Jacumin | 57/1 UN |

FOREIGN PATENT DOCUMENTS

| | | |
|---|---|---|
| 0041787 | 9/1980 | European Pat. Off. . |
| 0250025 | 12/1987 | European Pat. Off. . |
| 0311897 | 4/1989 | European Pat. Off. . |

*Primary Examiner*—Amy B. Vanatta
*Attorney, Agent, or Firm*—Ostrolenk, Faber, Gerb & Soffen, LLP

[57] ABSTRACT

A cylindrical shaped mandrel is used as a support inside the sleeve of tubular knit fabric, for maintaining the cylindrical shape of the fabric during extraction and compacting processes. Encasing the fabric and the mandrel is a larger diameter cylindrical ring member which presses the fabric against the mandrel in order to perform the extraction and compaction processes. The ring member extends for some distance in the longitudinal direction of travel of the knit fabric and contains a mechanism, such as a detent, for retaining the mandrel in place. A rope of tubular fabric is conveyed into the mandrel/ring assembly by an endless conveyor or belt made from a flexible material such as rubber. As the fabric is fed onto the mandrel, the belt forms a cylindrical sleeve around the fabric and the mandrel and is compressed by the cylindrical ring.

24 Claims, 7 Drawing Sheets

CYLINDRICAL BELT FINISHING MACHINE FOR KNIT FABRIC

This Appln claims the benefit of U.S. Provisional No. 60/072,408 filed Jan. 23, 1998.

BACKGROUND OF THE INVENTION

1. Field of the Invention

The present invention relates to a finishing machine for tubular knit fabrics, and more particularly to a cylindrical ring type compactor and extractor.

2. Related Art

Compactors and extractors are used in the finishing of tubular knit fabrics. Extractors are used to squeeze or pad a sleeve of tubular knit fabric in order to express the liquid retained in the fabric as a result of other finishing processes (e.g. dying, washing). A compactor is used to tighten the knit in the fabric through a process of longitudinally compressing the sleeve of fabric.

Conventional compactors and extractors, as depicted in FIG. 1, use a pair of rollers 100, 102 which define a nip through which an endless sleeve of tubular knit fabric 104 is fed. As a result of the finishing process using these prior art devices, permanent creases 106, 108 are formed in the sleeve tubular fabric 104. The permanent creases 106, 108 limit how the finished fabric 104 can be used because the creases are permanent and cannot be removed from the finished product.

Several prior art devices have been developed using tubular mandrels, but these devices have essentially been limited to the processes of stretching or cutting a tubular knit fabric. None of these devices can be adapted to the extraction or compacting processes required in the finishing of tubular knit fabrics.

Accordingly, there is a need in the art for an apparatus and method for performing extraction and compacting on tubular knit fabrics which does not create permanent edge creases in the finished product.

SUMMARY OF THE INVENTION

In order to overcome the disadvantages of the prior art compactors and extractors which employ conventional rollers, the present invention takes an entirely different approach by using a cylindrical shaped mandrel as an opener, spreader, of the knit fabric from rope form and as a support. The mandrel is positioned inside the sleeve of tubular knit fabric and maintains the tubular shape of the fabric during the extraction and compacting processes. Encasing the fabric and the mandrel is a larger diameter tubular ring member which presses the fabric against the mandrel in order to perform the extraction and compaction processes. The structure of the present invention thus allows for finishing of the tubular knit fabric in its tubular form. This structure finishes the tubular fabric without any creases whatsoever. The ring member extends for some distance in the longitudinal direction of travel of the knit fabric and contains a mechanism, such as a detent for retaining the mandrel in place.

A rope of tubular fabric is conveyed into the mandrel/ring assembly by an endless conveyor or belt made from a flexible material such as rubber. As the fabric is fed onto the mandrel, an upper surface of the belt material surrounds the fabric while the lower surface of the belt material comes into contact with the inner surface of the ring member. The mandrel, the lower surface of the belt material and inner surface of the ring member are manufactured with smooth surfaces in order to provide frictionless sliding contact therebetween.

Other features and advantages of the present invention will become apparent from the following description of the invention which refers to the accompanying drawings.

BRIEF DESCRIPTION OF THE DRAWING(S)

For the purpose of illustrating the invention, there is shown in the drawing a form which is presently preferred, it being understood, however, that the invention is not limited to the precise arrangement and instrumentality shown.

DETAILED DESCRIPTION OF THE INVENTION

Figure 1:
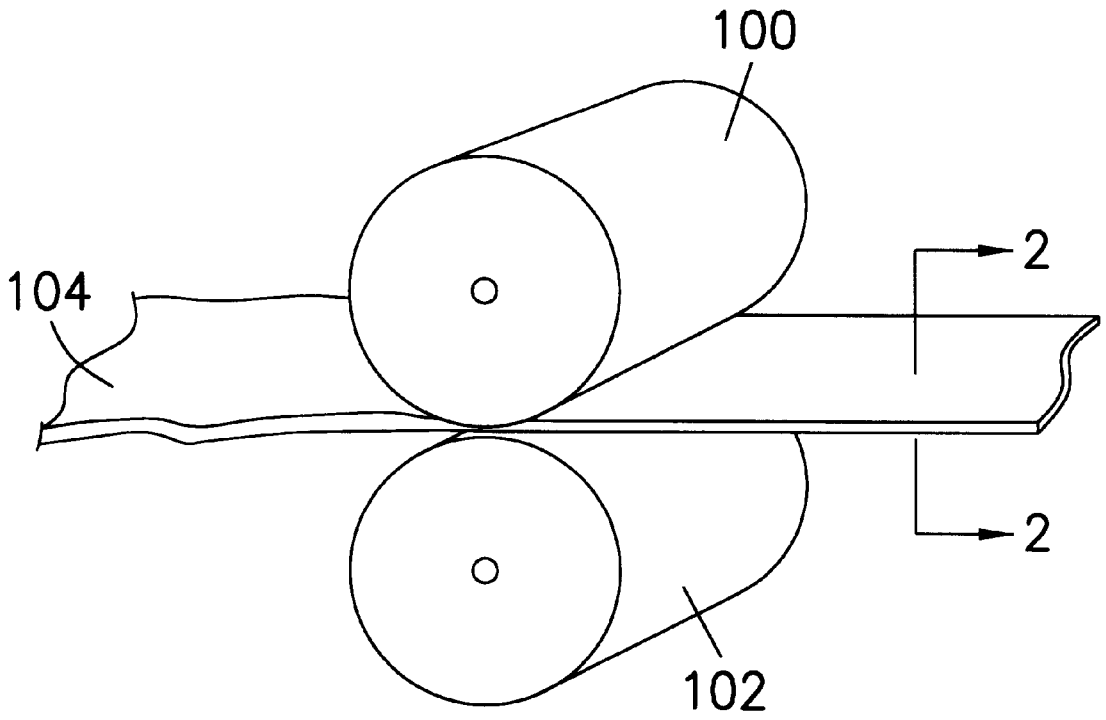
FIG. 1 is a diagram of a prior art compactor/extractor employing two rollers forming a nip.
Figure 2:
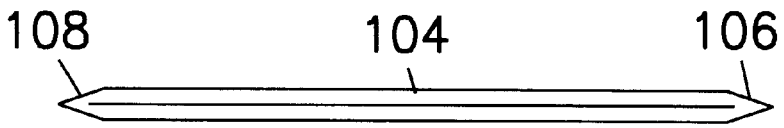
FIG. 2 is a cross section of FIG. 1 of the finished fabric as it exits in the prior art compactor/extractor.
Figure 3:
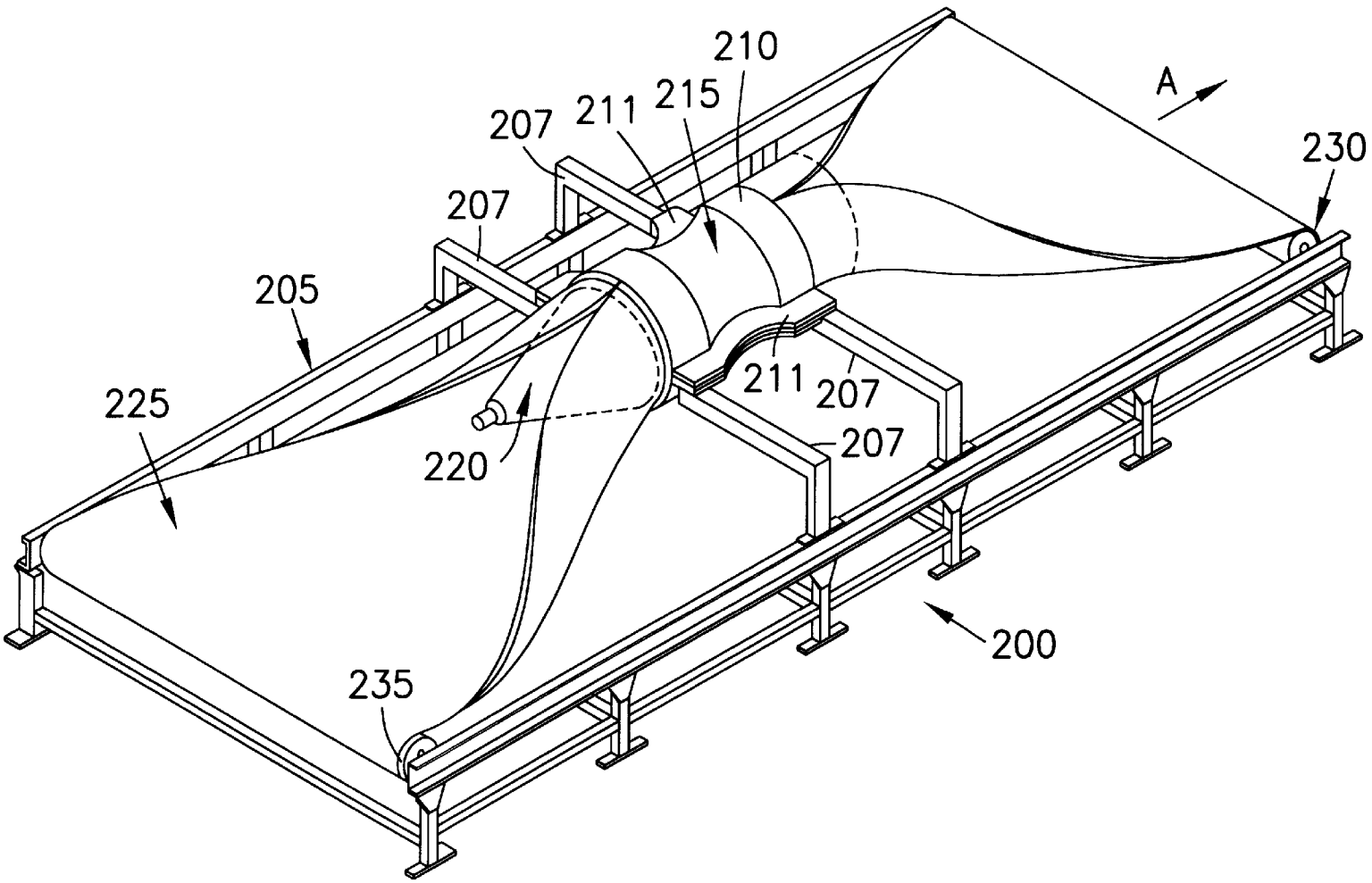
FIG. 3 is a perspective view of the finishing machine of the present invention.

Referring now to the drawings wherein like numerals indicate like elements, there is shown in FIG. 3 a perspective view of the compactor/extractor 200 of the present invention.

The compactor/extractor 200 includes and is supported by frame 205 which is constructed of rails and legs. Preferably frame 205 is constructed of stainless steel to inhibit rusting of the frame. Supported on structure 205 are two pair of rails 207 for mounting the mandrel 220 and ring 210 assembly. Ring 210 is mounted to rails 207 via hinged flanges 211 and locking flanges (not shown) on the other side of ring 210. As shown in later figures, ring 210 is constructed from two halves, can upper half and a lower half which are combined into the configuration depicted in FIG. 3 only after the mandrel 220 and belt 225 have been inserted thereinto. As depicted below, in operation, the tubular knit fabric to be finished can be manually threaded onto mandrel 220 and self threaded through the assembled ring 210 by the motion of belt 225. The two halves of ring 210 are fastened together, for example, by bolts hinges or other suitable fastening means.

Figure 4:
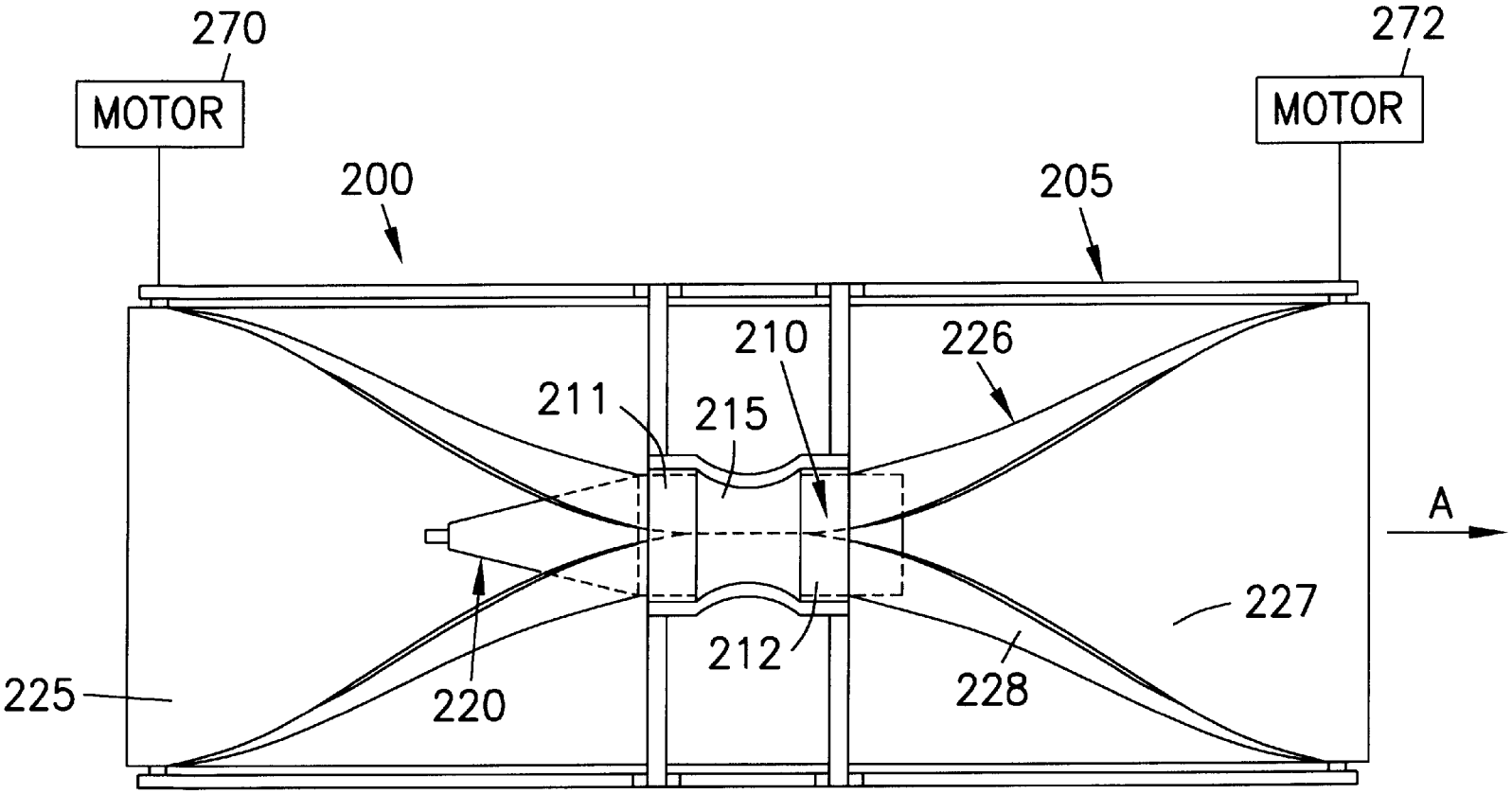
FIG. 4 is a plan view of the finishing machine of the present invention.

Mounted on the ends of frame 205 are drive rollers 230 and 235. These rollers 230 and 235 are rotatably mounted and are driven by an appropriate motor or motors 270, 272 (FIG. 4). As more fully described below, drive rollers 230 and 235 serve to drive the belt 225 which in turn carries the tubular knit fabric into the mandrel 220 and ring 210 assembly. Rollers 230, 235 can be driven synchronously or asynchronously depending on the particular operation being performed.

Referring now to FIG. 4, a detent 215 is formed in ring 210 in order to retain mandrel 220 in its proper position in ring 210. Mandrel 220 has a detent which corresponds to detent 215 in ring 210. Without detent 215, mandrel 210 would be carried along by belt 225 in its direction of travel indicated by arrow A. Other mechanisms for retaining mandrel 220 in ring 210 can be used such as having distal end 212 of ring 210 have a smaller diameter than that of proximal end 211. In such an embodiment, mandrel 220 is shaped such that its diameter is less than the diameter of proximal end 212 of ring 210. In the preferred embodiment of the present invention, the mandrel 220 and the proximal end 211 of ring 210 are substantially circular in cross section. Mandrel 220 and ring 210 are preferably manufactured from stainless steel in order to inhibit rusting.

As also depicted in FIG. 4, belt 225 has two surfaces, an upper surface 227 which comes into contact with the tubular knit fabric as is reaches compactor/extractor, and a lower surface 228 which contacts an inner surface of ring 210 at the point where the tubular knit fabric and belt 225 enter the mandrel 220 and ring 210 assembly. The lower surface 228 of belt 225 is in sliding contact with the inner surface of ring 210 and accordingly has a low coefficient of friction.

Figure 5:
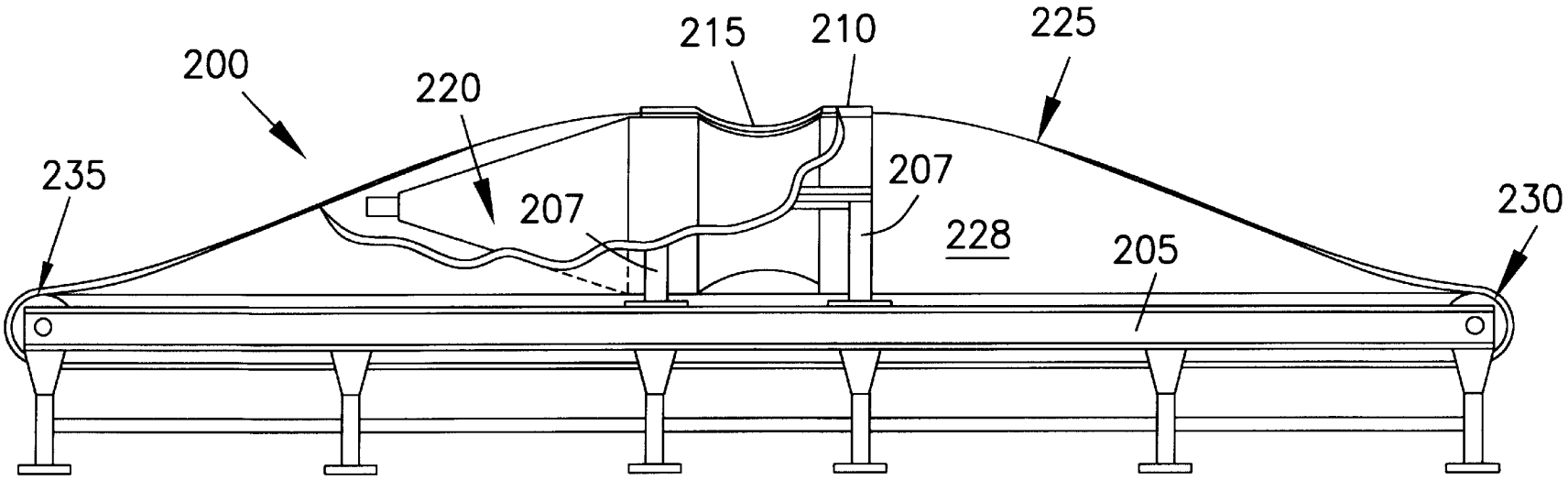
FIG. 5 is an elevation view of the finishing machine of the present invention.

FIG. 5 is side view of the compactor/extractor 200 of the present invention with a portion of belt 225 and ring 210 cut away to reveal mandrel 220 in its operating position. Again, detent 215 in ring 210 is shown cooperating with a corresponding detent in mandrel 220 in order to maintain mandrel 220 in it proper position. Although the length of frame 205 can be varied, in a preferred embodiment, frame 205 is approximately 25 feet. In an alternative embodiment of the present invention, two mandrel 220 and ring 210 assemblies are mounted to a single frame. The first mandrel 220 ring 210 assembly performing extraction on the tubular knit fabric while the second mandrel 220 ring 210 assembly performs a compaction operation. In such an embodiment, frame 205 is fifty to one hundred feet long. This alternative embodiment would also include dryer enclosures for drying the fabric after the extraction process and two different belts 225 of differing hardness for the extraction and compaction processes.

In the preferred embodiment, mandrel 220 is approximately ten feet in length with a maximum diameter of forty inches. Ring 210 is approximately four feet in length with a maximum diameter large enough to accommodate mandrel 200, the thickness of belt 225 and the thickness of tubular knit fabric being processed. This diameter is approximately one half inch to one and one half inches greater than the diameter of mandrel 220.

The diameters of mandrel 220 and ring 210 are adjusted to accommodate the diameter of the type of tubular knit fabric to be processed. For example, if the diameter of the fabric is thirty inches, mandrel 220 should be approximately 30 inches in diameter and ring 210 should be only slightly larger. In actual manufacturing operations, adjustable diameter mandrels 220 and rings 210 can be provided to several different size mandrel 220 and rings 210 can be made available for mounting to frame 205. Furthermore, different width belts 225 must be provided to accommodate different diameter fabrics. In one embodiment, frame 205 can have several pairs of rails 207 in order to mount several different diameter mandrel 220 and ring 210 assemblies.

Figure 9:
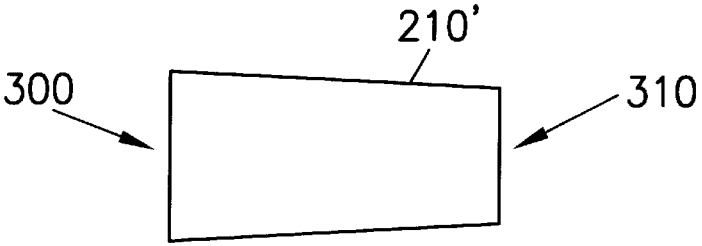
FIG. 9 is alternative embodiment of the mandrel of the present invention.

In the alternative embodiment depicted in FIG. 9, the ring 210' is formed with a frustoconical shape. In this embodiment, the front end 300 of ring 210' is large enough to accommodate the incoming belt 225 and tubular knit fabric being processed (see FIG. 8), while the rear end 310 has a diameter such that mandrel 220 (see FIG. 8) will not pulled out of the ring 210' along with the belt 225 and fabric. In this embodiment, as opposed to that depicted in FIG. 8, the mandrel 220 does not require any detents as required with the mandrel used in connection with ring 210 depicted in that Figure. The diameter of ring 210 at the front end 300 is approximately one half inch to one and one half inches greater than the diameter of mandrel 220 and the length is approximately four feet long.

Figure 6:
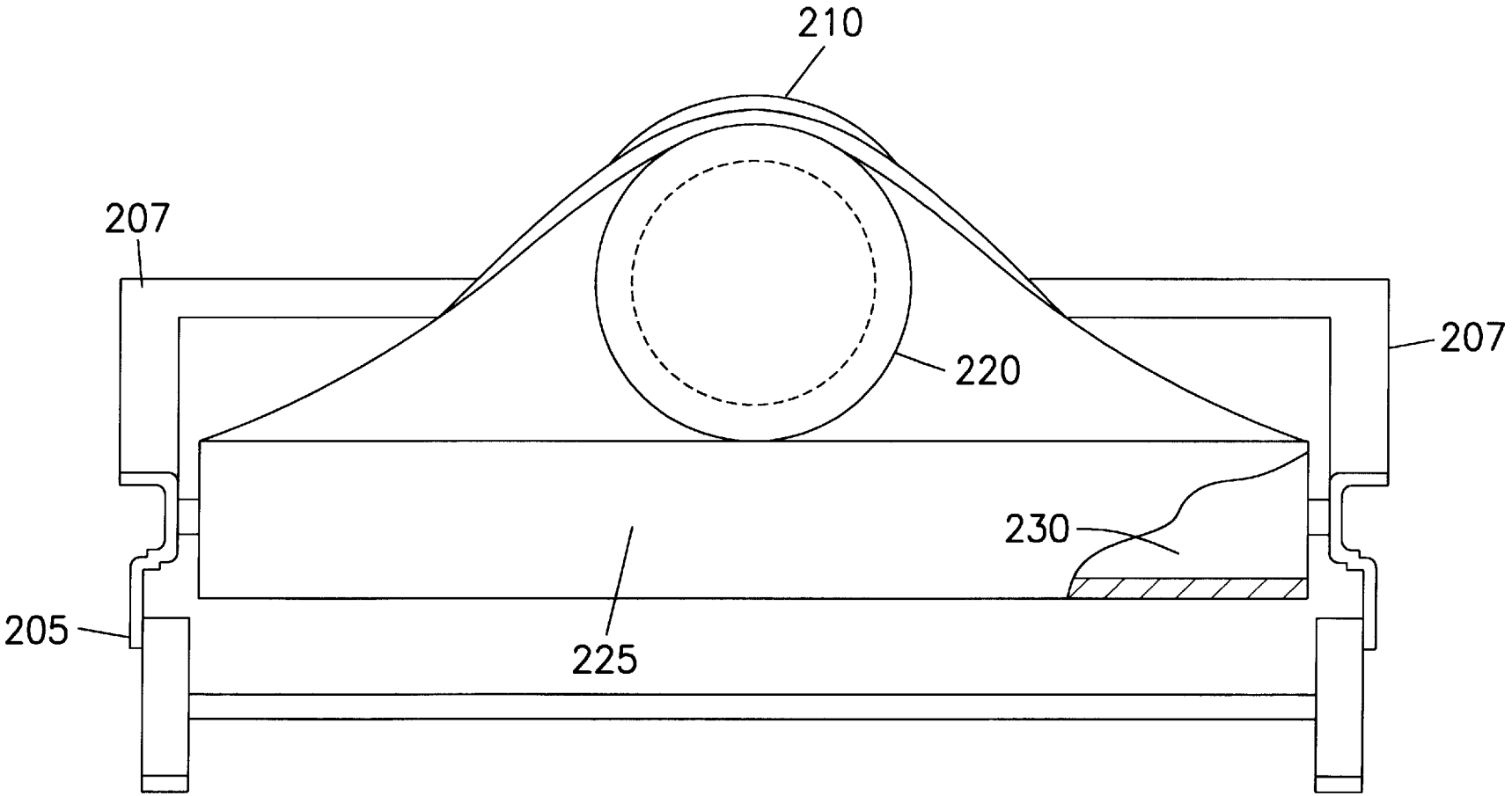
FIG. 6 is an end view of the finishing machine of the present invention.

FIG. 6 is a rear view of the compactor/extractor 200 of the present invention. Part of belt 225 has been cut away to reveal roller 230. As shown in this view, distal end of mandrel 220 has a circular cross-section, although this feature is not essential to the operation of compactor/extractor 200, the distal end of mandrel 200 which is outside of ring can essentially be of any shape desired. In the preferred embodiment depicted in FIG. 6, the shape is circular and is approximately the same diameter as the maximum diameter of mandrel 220. This shape is desired in order to maintain the shape of the tubular knit fabric as it exits ring 210. In an alternative embodiment, the proximal end of mandrel 220 can have a larger diameter cross section in order to transversely stretch a tubular knit fabric after it has been extracted. Furthermore, mandrel 220 can be heated in order to aid in the extraction and drying process.

Figure 7:
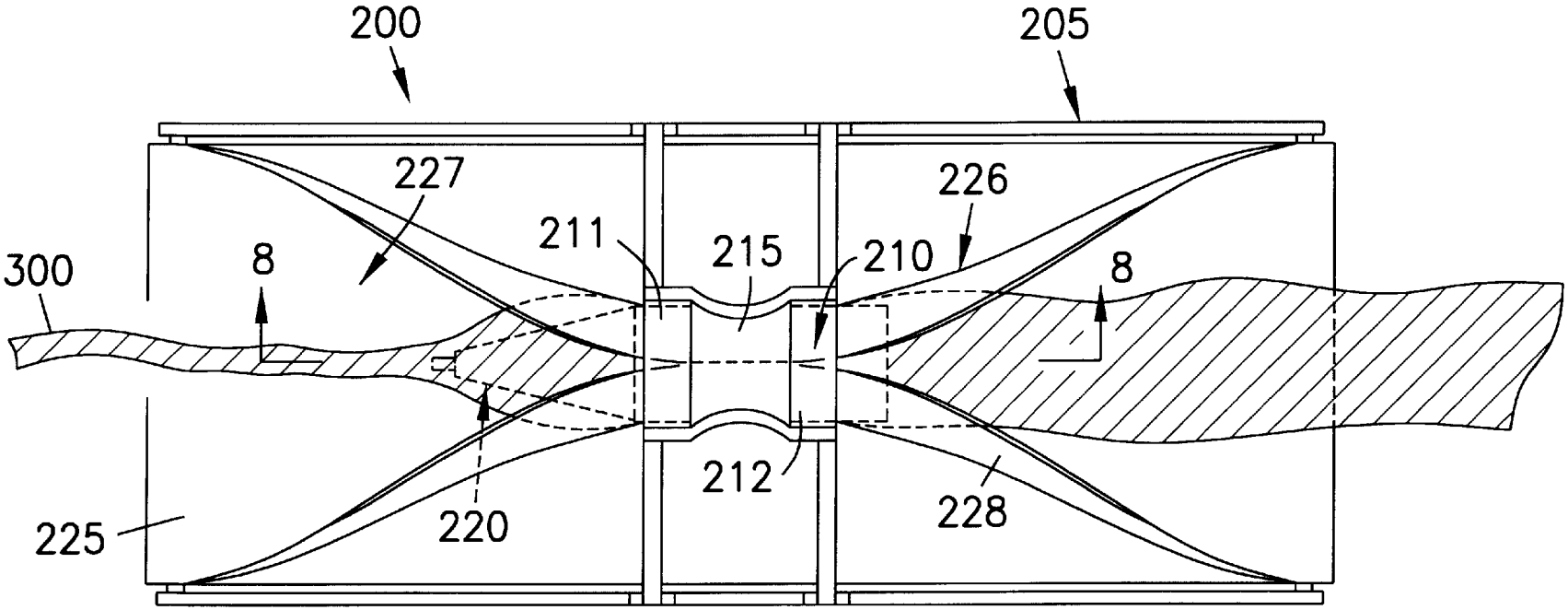
FIG. 7 illustrates the finishing machine with a length of tubular knit fabric thereon.
Figure 8:
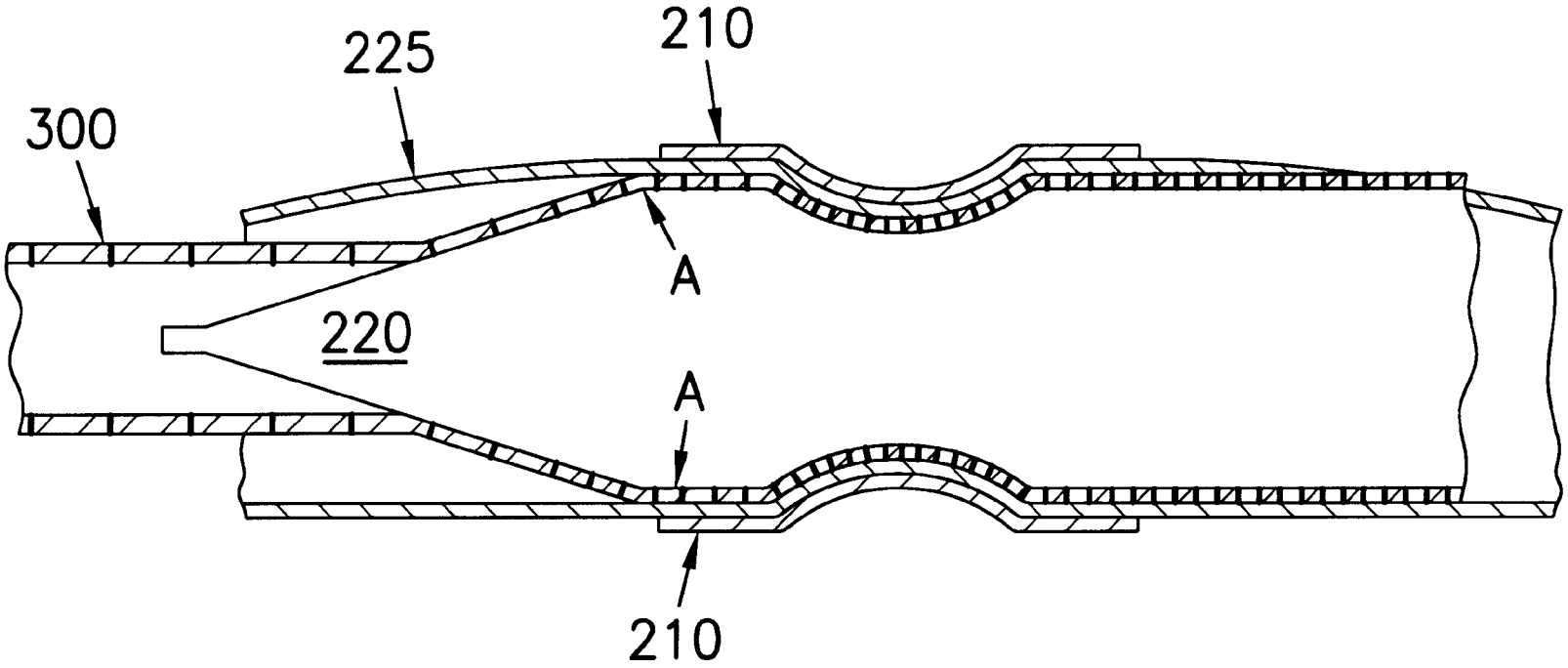
FIG. 8 is cross sectional view of FIG. 7.

FIGS. 7 and 8 depict the compactor/extractor 200 of the present invention when in actual operation. FIG. 7 is a similar view that of FIG. 4, except that a length of tubular knit fabric has been fed on compactor/extractor 200. FIG. 8 is cross section of FIG. 7 taken in the area of mandrel 220 and ring 210.

As seen in FIG. 7, tubular knit material 300 is initially fed onto belt 225. If the compactor/extractor 200 is being used for an extraction operation, fabric 300 is most likely in rope form and is saturated with liquid. In the initial setting up of compactor/extractor 200, the fabric is fed onto the distal conical end of mandrel 200 and is carried through ring 210 by the movement of belt 225.

As shown in FIG. 8, when in operation, the compactor/extractor 200 of the present invention essentially creates a sandwich configuration consisting of, from top to bottom, ring 210, belt 225, fabric 300, mandrel 220, fabric 300, belt 225 and the bottom half of ring 210. As the rollers 230, 235 (see FIG. 3) are driven, belt 225 will move in the direction of arrow A. Due to friction between fabric 300 and belt 225, fabric 300 will be carried along with belt 225 through the mandrel 220 ring 210 assembly.

In the preferred embodiment, the present invention can be used either as a compactor or an extractor. When used in the extraction mode, the pressure which ring 210 exerts against the belt 225 and fabric 300 will express the liquid cut of fabric 300. The belt 225 in an extractor 200 is constructed from a relatively hard rubber material with a hardness, for example, of 85 to 90 durometers. Mandrel 220 forms the support against which ring 210 exerts this pressure. Since fabric 300 is the element with the greatest degree of compressibility, it will tend to compress and thereby the liquid is squeezed out of the fabric 300. The ring 210 and mandrel 220 at point A in FIG. 8 essentially form a nip for expressing the water out of fabric 300.

By adjusting the distance, the gap, between the inner surface of ring 210 and mandrel 220, the amount of compression and therefore the amount of extraction of fabric 300 can be adjusted. At one extreme of compression, the sandwich of belt 225 and fabric 300 will not be able to move through the mandrel 220 ring 210 assembly. At the other end of compression, little to no force is exerted on the belt 225 or fabric 300 and therefore no liquid is expressed. In between these two extremes is a value of compression which will provide the proper amount of squeezing of the fabric 300. In one embodiment of the extractor of the present invention, the forward end of mandrel 220 is lower than the rear end in order to allow the extracted liquid to drain from the machine.

As stated above, the present invention can be used either as a compactor or an extractor. When used as a compactor, the function of the mandrel 220 and ring 210 assembly is to longitudinally tighten the stitches in the knit fabric. Compaction is accomplished by the present invention by driving roller 235 at a slightly higher speed than that of roller 230. The difference in speeds will tend to bunch, and therefore feed fabric 300 into the mandrel 220 ring 210 assembly. As the fabric 300 is forced into the gap between the mandrel 220 and the ring 210, the stitches in fabric 300 will be forced together and thereby shrink the length of the fabric 300. The ever closer hatched lines in the fabric 300 depicted in FIG. 8 illustrate this compaction of the stitches in fabric 300. When used as a compactor, the belt 225 is preferably made from a material with a greater compressibility than the belt 225 used for the extraction process.

As appreciated by those skilled in the art, steam can be applied to tubular knit fabric 300 prior to its entrance to the ring 210 and mandrel 220 assembly. As in the prior art, the steam provides moisture and heat to the fabric 300 in order to render it more pliable during the compaction process. A knife or other cutting device can be placed downstream from the exit end of the ring 210 in order to cut the tubular fabric 300 and deliver it open width to a desired size.

It is readily appreciated that the cylindrical construction of the apparatus of the present invention allows for finishing of the tubular knit fabric in its tubular form. This solves the greatest single problem with the prior art finishing machines which create creases in the tubular fabric by finishing the fabric in flat form. The present invention finishes the tubular fabric without any creases whatsoever. This advantage of the present invention provides a tremendous flexibility for the use of the tubular knit fabric previously unattainable in the prior art.

Although the application of the cylindrical machine of the present invention has been described with respect to extraction and compaction, the machine is a universal finishing machine and has applicability to all phases of finishing such as bleaching, dying and drying. For example, the cylindrical finishing machine of the present invention can be used in a dying process, either submerged in the dye bath itself or through application of the dye while the tubular knit fabric is in its spread state on the mandrel 220. This has clear advantages over the prior art because the edge creases created by the prior art generate inconsistent dying in the crease region. In a drying process, the ring 210 and mandrel 220 assembly can be encased in a dryer. The spreading of the fabric on the mandrel 200 will decrease the drying time and, as described above, will not impart any edge creases as created by the prior art finishing machines. Belt 225 can also be made of a porous material and a vacuum can be applied to the exterior to aid in the extraction and drying of the fabric.

Although the present invention has been described with respect to particular embodiments thereof, many other variations, modifications and other uses will be apparent to those skilled in the art. Accordingly, the present invention should not be limited by the specific disclosure contained herein.

I claim:

1. An apparatus for finishing tubular knit fabric comprising:

a frame;

an endless belt supported on the frame, wherein the tubular knit fabric to be finished is carried on the endless belt;

a ring supported on the frame; and a mandrel disposed within the ring.

2. The apparatus for finishing tubular knit fabric as recited in claim 1, wherein the tubular knit fabric is fitted onto the mandrel and wherein the ring is adapted to receive the belt and the tubular knit fabric after the tubular knit fabric has been fitted onto the mandrel.

3. The apparatus for finishing tubular knit fabric as recited in claim 2, wherein a bottom side of the belt contacts an interior side of the ring, and wherein a top side of the belt contacts an exterior of the tubular knit fabric.

4. The apparatus for finishing tubular knit fabric as recited in claim 1, wherein the apparatus is an extractor and wherein the mandrel and ring cooperate to compress the tubular knit fabric to thereby extract a liquid therefrom.

5. The apparatus for finishing tubular knit fabric as recited in claim 1, wherein the apparatus is a compactor and wherein the mandrel and ring cooperate to compact a lengthwise stitching of the tubular knit fabric.

6. The apparatus for finishing tubular knit fabric as recited in claim 1, wherein the ring is substantially cylindrical with an annular detent therein, and wherein the mandrel has a corresponding detent, the detents preventing the mandrel from being dislodged from the ring.

7. The apparatus for finishing tubular knit fabric as recited in claim 1, wherein the ring is frustroconical in shape, an opening in a front end of the ring having a diameter that is larger than an opening in a rear end of the ring, whereby the mandrel is prevented from being dislodged from the ring.

8. The apparatus for finishing tubular knit fabric as recited in claim 1, wherein the mandrel has a conical shaped front end for receiving the tubular knit fabric, the conical front end spreading the tubular knit fabric from an interior thereof.

9. The apparatus for finishing tubular knit fabric as recited in claim 1, wherein an interior diameter of the ring is larger than a combination of the thickness of the belt, a thickness of the tubular knit fabric and an outside diameter of the mandrel.

10. The apparatus for finishing tubular knit fabric as recited in claim 1, wherein the belt is made from a compressible material.

11. The apparatus for finishing tubular knit fabric as recited in claim 1, wherein the frame has a front end and a rear end, the apparatus further comprising:

rollers attached to each of the front end and the rear end, the belt being coupled to the rollers; and at least one drive mechanism attached to at least one of the rollers, wherein operation of the drive mechanism rotates the at least one roller and thereby moving the belt.

12. The apparatus for finishing tubular knit fabric as recited in claim 1, wherein the ring has a first half and a second half, the first and second halves being combined after the mandrel and the belt have been inserted between the first half and the second half.

13. An apparatus for finishing tubular knit fabric comprising:

a frame;

an endless belt supported on the frame;

a ring supported on the frame and adapted to receive the belt and the tubular knit fabric to be finished; and a mandrel disposed within the ring and adapted to press the tubular knit fabric to be finished and the belt to an interior surface of the ring.

14. The apparatus for finishing tubular knit fabric as recited in claim 13, wherein the mandrel is adapted to fit into an interior of the tubular knit fabric and to thereby spread the fabric.

15. The apparatus for finishing tubular knit fabric as recited in claim 13, wherein the apparatus is an extractor and wherein the mandrel and ring cooperate to compress the tubular knit fabric to thereby extract a liquid therefrom.

16. The apparatus for finishing tubular knit fabric as recited in claim 13, wherein the apparatus is a compactor and wherein the mandrel and ring cooperate to compact a lengthwise stitching of the tubular knit fabric.

17. The apparatus for finishing tubular knit fabric as recited in claim 13, wherein the mandrel has a conical shaped front end for receiving the tubular knit fabric, the conical front end spreading the tubular knit fabric from an interior thereof.

18. The apparatus for finishing tubular knit fabric as recited in claim 13, wherein the frame has a front end and a rear end, the apparatus further comprising:

rollers attached to each of the front end and the rear end, the belt being coupled to the rollers; and at least one drive mechanism attached to at least one of the rollers, wherein operation of the drive mechanism rotates the at least one roller and thereby moving the belt.

19. A method of finishing tubular knit fabric comprising the steps of:

conveying, on a belt, the tubular knit fabric onto a mandrel disposed in a ring;

spreading the tubular knit fabric with the mandrel; and conveying the belt and the tubular knit fabric between the mandrel and the ring.

20. The method for finishing tubular knit fabric as recited in claim 19, further comprising the steps of:

fitting the tubular knit fabric onto the mandrel; and receiving the belt and the tubular knit fabric into the ring after the mandrel has been fitted into the tubular knit fabric.

21. The method for finishing tubular knit fabric as recited in claim 19, further comprising the step of:

compressing the tubular knit fabric between the ring and the mandrel to thereby extract a liquid from the tubular knit fabric.

22. The method for finishing tubular knit fabric as recited in claim 19, further comprising the step of:

compacting a lengthwise stitching of the tubular knit fabric in the ring and mandrel assembly.

23. The method for finishing tubular knit fabric as recited in claim 19, wherein the mandrel has a conical shaped front end and wherein the step of spreading the tubular knit fabric is accomplished by the conical front end of the mandrel.

24. The method for finishing tubular knit fabric as recited in claim 19, wherein the ring is supported on a frame, wherein the frame has a front end and a rear end and rollers attached to each of the front end and the rear end, and wherein the belt is coupled to the rollers, the method further comprising:

rotating at least one roller to thereby move the belt.

* * * * *

UNITED STATES PATENT AND TRADEMARK OFFICE

CERTIFICATE OF CORRECTION

PATENT NO. : 6,047,452
DATED : April 11, 2000
INVENTOR(S) : Frank Caruso

It is certified that error appears in the above-identified patent and that said Letters Patent is hereby corrected as shown below:

Please correct the Inventors address to read as follows:

40-14 220th Street
Bayside, N.Y. 11361

Signed and Sealed this

Eleventh Day of December, 2001

*Attest:*

Nicholas P. Godici

*Attesting Officer*

NICHOLAS P. GODICI
*Acting Director of the United States Patent and Trademark Office*